US006298520B1

(12) United States Patent
Blickhahn et al.

(10) Patent No.: US 6,298,520 B1
(45) Date of Patent: Oct. 9, 2001

(54) DOOR CLOSER AND MOUNTING BRACKET

(75) Inventors: Robert J. Blickhahn; Scott C. Perry; James E. Jensen, all of Princeton; Andy Current, Oglesby; Craig L. Lucas, Princeton, all of IL (US)

(73) Assignee: Schlage Lock Company, San Francisco, CA (US)

( * ) Notice: Subject to any disclaimer, the term of this patent is extended or adjusted under 35 U.S.C. 154(b) by 0 days.

(21) Appl. No.: 09/419,419

(22) Filed: Oct. 15, 1999

Related U.S. Application Data

(63) Continuation-in-part of application No. 09/192,695, filed on Nov. 16, 1998, now Pat. No. 6,125,505.

(51) Int. Cl.[7] ..... E05F 1/00

(52) U.S. Cl. ..... 16/71; 16/49; 16/51; 16/66; 16/DIG. 40; 49/358; 248/200

(58) Field of Search ..... 16/71, 49, 84, 16/51, 66, 64, 82, DIG. 40; 248/200, 316.7, 229.16, 229.26, 231.81; 49/358, 137, 501

(56) References Cited

U.S. PATENT DOCUMENTS

| | | | | |
|---|---|---|---|---|
| 4,083,080 | * | 4/1978 | Miyazawa | 16/69 |
| 4,179,092 | * | 12/1979 | Miyazawa | 16/49 |
| 4,831,687 | * | 5/1989 | Lin et al. | 16/49 |
| 5,265,306 | * | 11/1993 | Yu | 16/51 |
| 5,392,562 | * | 2/1995 | Carambula | 49/346 |
| 5,810,311 | * | 9/1998 | Davision et al. | 248/316.7 |

* cited by examiner

*Primary Examiner*—Chuck Y. Mah
(74) *Attorney, Agent, or Firm*—Donald W. Walk

(57) ABSTRACT

A door closer and mounting bracket for attaching the door closer to either the door or the door frame. The door closer includes two pins at one end for engaging corresponding holes on the mounting bracket and the mounting bracket includes a resilient clip for engaging the body of the door closer.

4 Claims, 3 Drawing Sheets

DOOR CLOSER AND MOUNTING BRACKET

This application is a continuation-in-part of U.S. patent application Ser. No. 09/192,695, filed Nov. 16, 1998, now U.S. Pat. No. 6,125,505.

BACKGROUND OF THE INVENTION

This invention relates generally to door closers and more particularly to mounting brackets for door closers.

Current state of the art door closers in the commercial market attach to the door or door frame using very similar methods. They all use fasteners to directly attach the door closer to the door or door frame.

One problem with current door closers is that after the mounting holes are drilled into the door, the door closer must be held in place while the fasteners are inserted and tightened. A door closer can weigh as much as 8 to 10 pounds. This heavy weight must be supported while the fasteners are being tightened. This can make the installation difficult.

The foregoing illustrates limitations known to exist in present door closers. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a door closer having at least one engagement member extending from a first part thereof; and a mounting bracket adapted to be attached to one of a door surface or a door frame surface, the mounting bracket having two door closer retaining members thereon, the first door closer retaining member engaging the at least one door closer engagement member, the second door closer retaining member engaging the door closer at a position offset from the door closer pin.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
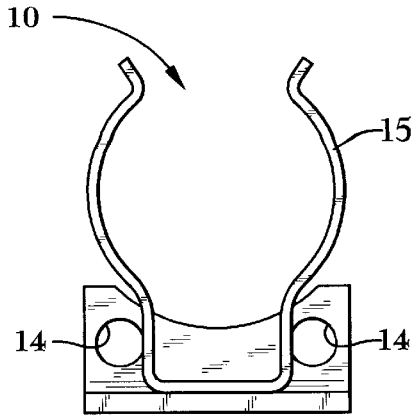
FIG. 1 is an end view of a mounting bracket according to the present invention.
Figure 2:
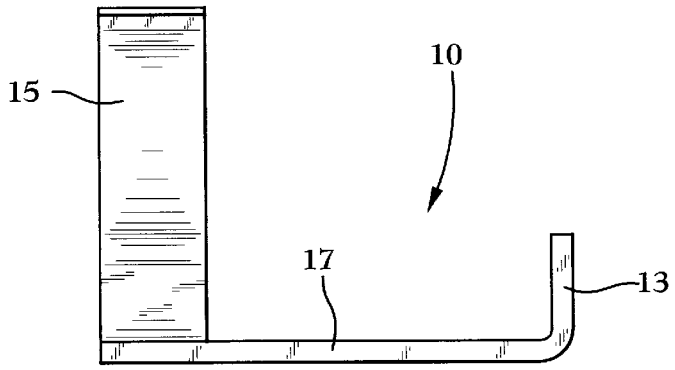
FIG. 2 is a side view of the mounting bracket shown in FIG. 1.
Figure 3:
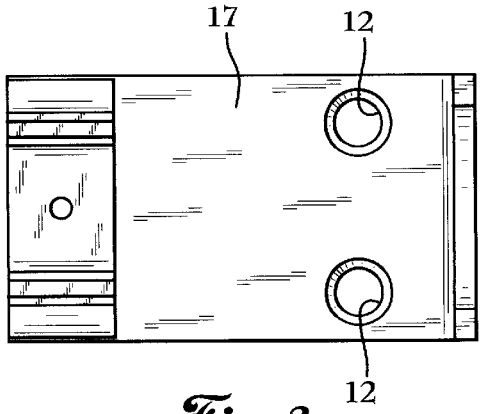
FIG. 3 is a top view of the mounting bracket shown in FIG. 1.
Figure 5:
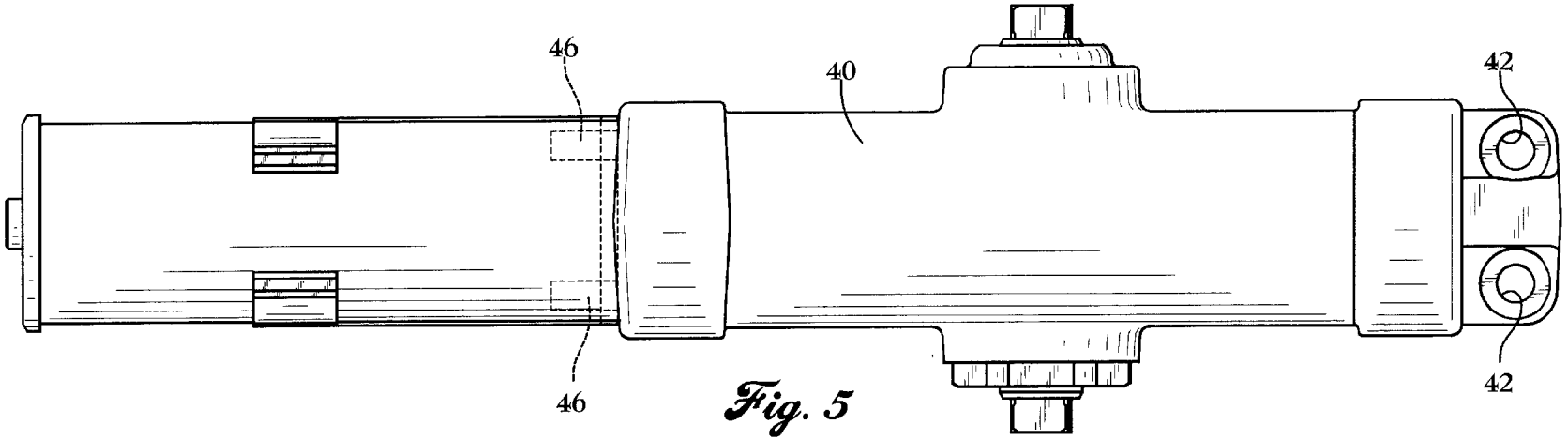
FIG. 5 is a top view of the mounting bracket and door closer shown in FIG. 4.
Figure 4:
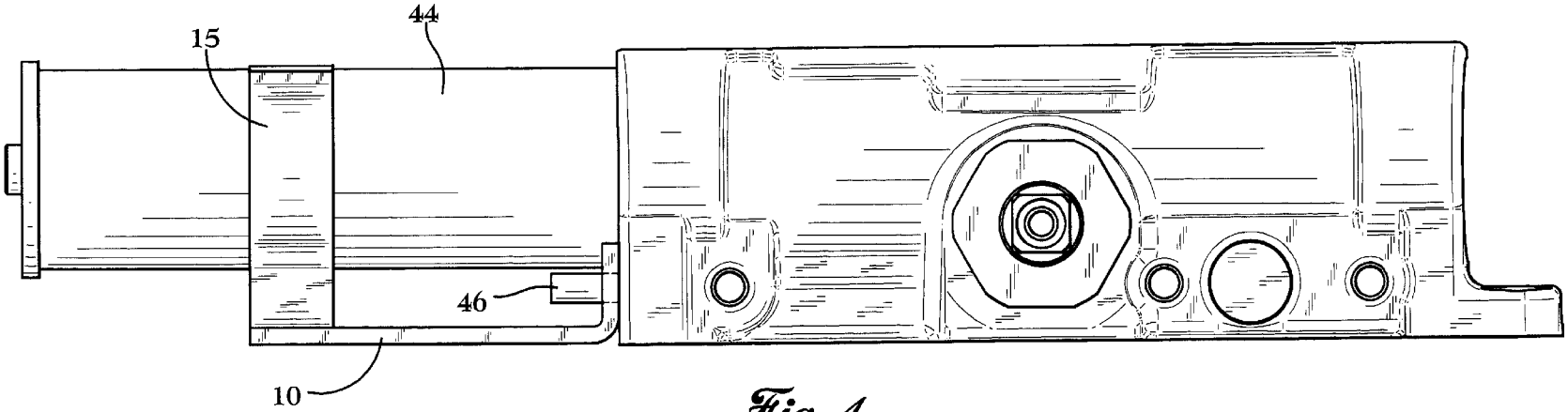
FIG. 4 is a side view of the mounting bracket shown in FIG. 1, showing a door closer mounted within the mounting bracket.
Figure 6A:
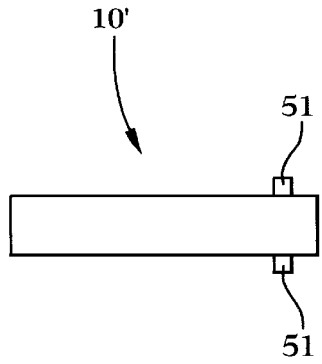
FIG. 6A is a schematic view of a first alternate embodiment of the mounting bracket of the present invention.
Figure 6B:
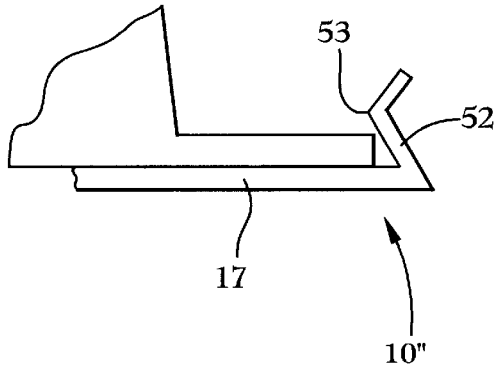
FIG. 6B is a schematic view of a second alternate embodiment of the mounting bracket of the present invention.
Figure 6C:
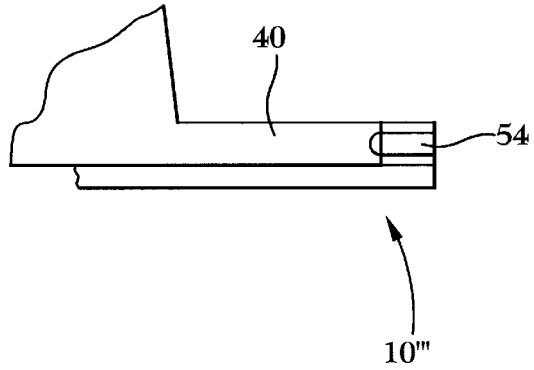
FIG. 6C is a schematic view of a third alternate embodiment of the mounting bracket of the present invention.
Figure 6D:
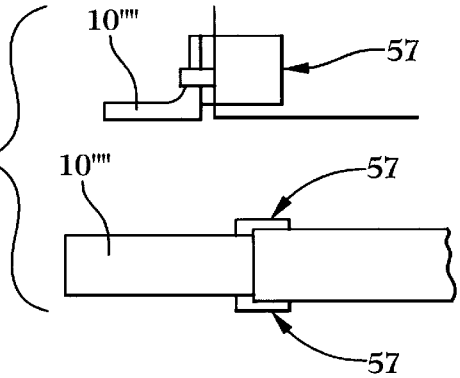
FIG. 6D is a schematic view of a fourth alternate embodiment of the mounting bracket of the present invention.

FIGS. 1 through 3 show a "hands-free" mounting bracket 10 for use with a door closer 40 (shown in FIGS. 4 and 5). The mounting bracket 10 includes a base 17 which has a plurality of mounting holes 12 which are used to attach the mounting bracket 10 to either a door or door frame using screws or other fasteners. The mounting bracket 10 has an end tab 13 extending from the base 17 at a right angle to the base 17. The end tab 13 has a plurality of pin holes 14. Offset from the end tab 13 is a "spring" clip 15. Preferably, clip 15 is formed from spring steel, although other materials can be used as long the material permits clip 15 to move or resiliently flex to permit a portion of the door closer 40 to fit into the clip 15 as the door closer 40 is attached to the mounting bracket 10.

In use, the mounting bracket 10 is attached to the door or door frame using fasteners through mounting holes 12. Door closer 40, which has pins 46 extending from the door closer, is attached to the mounting bracket 10 by 1) pushing the door closer 40 onto the mounting bracket clip 15, permitting the clip 15 to "snap" onto a spring tube portion 44 of the door closer 40 and then 2) sliding pins 46 into pin holes 14 in the mounting bracket 10. This now temporarily retains the door closer 40 in the mounting bracket 10, i.e. "hands free". The door closer installation can be completed by fastening the door closer 40 to the door or door frame with fasteners installed using mounting holes 42. The mounting bracket 10 uses two spatially separated points of engagement to temporarily hold the door closer 40 on the mounting bracket 10. Shown in FIGS. 1 through 5 is the preferred embodiment, which uses pins 46. Other means of engaging the door closer 40 with the mounting bracket 10 can be used, such as protrusions from the door closer body.

Four alternate embodiments of a mounting bracket 10, using two point engagement between the mounting bracket 10 and the door closer 40, are shown in FIGS. 6A, 6B, 6C and 6D. These four embodiments use the door closer pins 46 and mounting bracket pin holes 14 described above for the first door closer retaining member. The mounting bracket 10', shown in FIG. 6A, uses one or more bendable tabs 51 extending from the mounting bracket 10'. The door closer pins 46 are slid into pin holes 14. Tabs 51 are then bent over the adjacent portions of the door closer 40, thereby temporarily retaining the door closer 40 on the mounting bracket 10' until the installation can be completed. The mounting bracket 10" , shown in FIG. 6B, uses a tab portion 52 extending from the base 17. The tab portion 52 includes a snap portion 53 having a shape that permits the tab portion 52 to flex or "snap" over an adjacent portion of the door closer 40. Once the tab portion 52 has "snapped" over the door closer 40, the door closer 40 is temporarily retained on the mounting bracket 10" until the installation can be completed. The mounting bracket 10'", shown in FIG. 6C, uses a moveable pin 54 which fits into a corresponding hole in the door closer 40. After the door closer 40 has been fitted onto mounting bracket 10'", pin 54 is slid into the corresponding hole in the door closer 40, thereby temporarily retaining the door closer 40 on the mounting bracket 10'" until the installation can be completed. The mounting bracket 10"", shown in FIG. 6D, uses a pair of retaining brackets 57 which extend from the end tab 13 of mounting bracket 10"" and grip the sides of door closer 40. Retaining brackets 57 can also flex, similar to tab positions 52 or clip 15, to facilitate attachment of the door closer 40 to mounting bracket 10"".

Having described the invention, what is claimed is:

1. In combination:

a door closer having at least one door closer engagement member extending from a first part thereof; and a mounting bracket adapted to be attached to one of a door surface or a door frame surface, the mounting bracket having two door closer retaining members thereon, the first door closer retaining member engaging the at least one door closer engagement member, the second door closer retaining member engaging the door closer at a position offset from the door closer engagement member and comprising at least one bendable tab extending from the mounting bracket, the at least one bendable tab being bent over an adjacent portion of the door closer after the door closer is attached to the mounting bracket.

2. In combination:

a door closer having at least one door closer engagement member extending from a first part thereof; and a mounting bracket adapted to be attached to one of a door surface or a door frame surface, the mounting bracket having two door closer retaining members thereon, the first door closer retaining member engaging the at least one door closer engagement member, the second door closer retaining member engaging the door closer at a position offset from the door closer engagement member and comprising at least one tab portion extending from the mounting bracket, the at least one tab portion including a snap portion which engages a portion of the door closer after the door closer is attached to the mounting bracket, the at least one tab portion being resilient to allow the snap portion to move away from the door closer while the door closer is being attached to the mounting bracket.

3. In combination:

a door closer having at least one door closer engagement member extending from a first part thereof; and a mounting bracket adapted to be attached to one of a door surface or a door frame surface, the mounting bracket having two door closer retaining members thereon, the first door closer retaining member engaging the at least one door closer engagement member, the second door closer retaining member engaging the door closer at a position offset from the door closer engagement member and comprising at least one moveable pin for engaging an at least one corresponding aperture in the door closer.

4. In combination:

a door closer having at least one pin extending from a first part thereof; and a mounting bracket adapted to be attached to one of a door surface or a door frame surface, the mounting bracket having a base portion with a plurality of mounting holes therein, and two door closer retaining members from the base portion, the first door closer retaining member engaging the at least one door closer pin, the second door closer retaining member comprising a resilient clip for engaging a body portion of the door closer.

* * * * *